US007713180B2

(12) United States Patent
Wickens et al.

(10) Patent No.: US 7,713,180 B2
(45) Date of Patent: May 11, 2010

(54) PARTIALLY STABILIZED EXERCISE DEVICE WITH VALVE MECHANISM

(75) Inventors: Krista Marie Wickens, Ogden, UT (US); Jaremy T. Butler, Paradise, UT (US); Donald Jack Standing, Smithfield, UT (US)

(73) Assignee: ICON IP, Inc., Logan, UT (US)

( * ) Notice: Subject to any disclaimer, the term of this patent is extended or adjusted under 35 U.S.C. 154(b) by 0 days.

(21) Appl. No.: 11/182,174

(22) Filed: Jul. 15, 2005

(65) Prior Publication Data

US 2006/0063653 A1 Mar. 23, 2006

Related U.S. Application Data

(63) Continuation-in-part of application No. 10/718,005, filed on Nov. 19, 2003, now abandoned, and a continuation-in-part of application No. 10/969,539, filed on Oct. 20, 2004, now abandoned.

(51) Int. Cl.
*A63B 26/00* (2006.01)

(52) U.S. Cl. ..... 482/140; 482/907

(58) Field of Classification Search ..... 482/140, 482/148, 907, 91; 446/220
See application file for complete search history.

(56) References Cited

U.S. PATENT DOCUMENTS

| | | | |
|---|---|---|---|
| 1,730,309 | A | 10/1929 | Tubbs |
| D153,191 | S | 3/1949 | Walters |
| 2,764,859 | A | 10/1956 | Hanselmann |
| 3,307,319 | A | 3/1967 | Christensen et al. |
| 3,458,966 | A | 8/1969 | Dunbar et al. |
| 3,899,210 | A | 8/1975 | Samhammer et al. |
| 3,935,690 | A | 2/1976 | Lea et al. |
| 3,965,506 | A | 6/1976 | Marks |
| 3,968,620 | A | 7/1976 | Keltner |
| 3,992,733 | A | 11/1976 | Racine |
| 4,011,611 | A | 3/1977 | Lederman |

(Continued)

FOREIGN PATENT DOCUMENTS

| | | | |
|---|---|---|---|
| DE | 4221104 | A1 | 6/1992 |

(Continued)

OTHER PUBLICATIONS

Photographs of tennis ball partially filled with sand and shown to examiner on Apr. 17, 2007, and available, on information and belief, at juggling promotion prior to Oct. 2002.

(Continued)

*Primary Examiner*—Lori Baker
(74) *Attorney, Agent, or Firm*—Workman Nydegger

(57) ABSTRACT

An exercise device includes an inflatable bladder and is partially stabilized with a small amount of filler. The bladder includes a first aperture to allow the filler to be easily placed in the bladder. The bladder also includes a valve main body that allows air to be easily injected into the bladder to inflate the bladder. In an exemplary method the filler is forced into the inflatable bladder using a mixture of air and filler. The air is under pressure and assists in forcing the filler into the bladder. After a proper amount of filler is in the bladder, the bladder can be deflated for packaging and/or shipping.

35 Claims, 11 Drawing Sheets

U.S. PATENT DOCUMENTS

| | | | | |
|---|---|---|---|---|
| 4,016,707 | A | 4/1977 | Puchosic | |
| 4,027,888 | A | 6/1977 | Wilcox | |
| 4,184,237 | A | 1/1980 | Blankenship | |
| 4,327,046 | A | 4/1982 | Davis et al. | |
| 4,418,514 | A | 12/1983 | Spann | |
| 4,841,713 | A | 6/1989 | Beier | |
| 4,915,669 | A * | 4/1990 | Russell | 446/221 |
| 4,928,337 | A | 5/1990 | Chauncey | |
| 5,106,884 | A | 4/1992 | Turner et al. | |
| 5,190,504 | A | 3/1993 | Scatterday | |
| 5,228,158 | A | 7/1993 | Park | |
| 5,242,348 | A | 9/1993 | Bates | |
| 5,265,295 | A | 11/1993 | Sturgis | |
| 5,350,342 | A | 9/1994 | Scatterday | |
| D355,077 | S | 2/1995 | Tegner | |
| 5,413,332 | A | 5/1995 | Montgomery | |
| 5,433,438 | A | 7/1995 | Gilman | |
| 5,476,184 | A | 12/1995 | Hill | |
| 5,496,026 | A | 3/1996 | Montgomery | |
| 5,566,953 | A | 10/1996 | Arriola et al. | |
| 5,620,069 | A | 4/1997 | Hurwitz | |
| D384,211 | S | 9/1997 | Wied et al. | |
| 5,718,655 | A * | 2/1998 | Phillips | 482/49 |
| 5,733,012 | A | 3/1998 | Jones | |
| 5,755,648 | A | 5/1998 | Kildani | |
| 5,772,543 | A | 6/1998 | Paino | |
| 5,813,932 | A | 9/1998 | Grafton | |
| 5,839,992 | A | 11/1998 | Phillips | |
| 5,863,278 | A | 1/1999 | Chen | |
| 5,878,551 | A | 3/1999 | Curley et al. | |
| 5,891,000 | A | 4/1999 | Phillips | |
| 6,053,829 | A | 4/2000 | Conley | |
| 6,141,807 | A | 11/2000 | Tapper | |
| 6,149,555 | A | 11/2000 | Kinback | |
| 6,186,662 | B1 | 2/2001 | Jackson | |
| 6,241,637 | B1 | 6/2001 | Basyuk | |
| 6,279,184 | B1 | 8/2001 | George, II | |
| 6,328,675 | B1 | 12/2001 | Kaye | |
| 6,334,227 | B1 | 1/2002 | Larger | |
| 6,363,557 | B2 | 4/2002 | Chou | |
| 6,387,022 | B1 | 5/2002 | Smith | |
| 6,464,999 | B1 * | 10/2002 | Huo et al. | 424/422 |
| 6,532,613 | B2 | 3/2003 | Berry, IV | |
| 6,547,706 | B1 | 4/2003 | Chek | |
| 6,652,421 | B1 | 11/2003 | Chen | |
| 6,725,482 | B2 | 4/2004 | George, II | |
| 6,732,391 | B2 | 5/2004 | George, II | |
| 6,746,372 | B2 | 6/2004 | Hsu | |
| 6,837,835 | B2 | 1/2005 | Huang | |
| 6,837,836 | B2 | 1/2005 | Huang | |
| 6,952,906 | B2 * | 10/2005 | Nelson | 53/434 |
| 7,007,330 | B2 * | 3/2006 | Kuiper et al. | 5/715 |
| 2002/0111109 | A1 * | 8/2002 | Kwan | 446/220 |
| 2003/0060346 | A1 | 3/2003 | Wu | |
| 2003/0066268 | A1 | 4/2003 | George, II | |
| 2003/0148860 | A1 | 8/2003 | Wren | |
| 2003/0151295 | A1 | 8/2003 | Nelson | |
| 2004/0110611 | A1 | 6/2004 | Huang | |
| 2004/0110613 | A1 | 6/2004 | Huang | |
| 2005/0107229 | A1 | 5/2005 | Wickens | |
| 2005/0143234 | A1 | 6/2005 | Massey | |

FOREIGN PATENT DOCUMENTS

| | | | |
|---|---|---|---|
| DE | 4221104 | A1 * | 6/1992 |
| EP | 0705760 | A1 | 4/1996 |
| EP | 0705760 | B1 | 3/1999 |
| GB | 2214071 | A | 8/1989 |
| WO | WO 1987/002643 | | 5/1987 |

OTHER PUBLICATIONS

Photographs of tennis ball partially filled with sand and available, on information and belief, at juggling promotion prior to Oct. 2002.

PCT International Search Report, international application No. PCT/US06/27481, mailed Mar. 1, 2007.

PCT Written Opinion of the International Searching Authority, international application No. PCT/US06/27481, mailed Mar. 1, 2007.

Remarks, p. 11 of 14, Response to Office Action dated Jun. 19, 2007, U.S. Appl. No. 11/182,174.

"Partial European Search Report," European Patent Application No. 0 705 760 dated Feb. 1, 1996 (1 page).

White, Frank M., Fluid Mechanics, 1994, p. 187, Third Edition, McGraw Hill, Inc.

Parker, Sybil P., "Venturi Tube," Concise Encyclopedia of Science & Technology, 1994, p. 2003, Third Edition, McGraw-Hill, Inc.

"Carburetor," The World Book Encyclopedia, 1985, pp. 169-170, C-Ch, vol. 3, World Book, Inc.

"How Glass is Decorated," The World Book Encyclopedia, 1985, p. 207, G, vol. 8, World Book, Inc.

"Sandblasting," The World Book Encyclopedia, 1985, p. 97, S-Sn, vol. 17, World Book, Inc.

* cited by examiner

PARTIALLY STABILIZED EXERCISE DEVICE WITH VALVE MECHANISM

CROSS REFERENCE TO RELATED APPLICATIONS

The present application is a continuation-in-part of U.S. patent application Ser. No. 10/718,005, filed Nov. 19, 2003 now abandoned, and entitled "PARTALLY STABILIZED EXERCISE DEVICE". U.S. patent application Ser. No. 10/969,539, filed Oct. 20, 2004, and entitled "PARTIALLY STAIBILIZED EXERCISE DEVICE," which is abandoned, is incorporated herein by reference in its entirely.

BACKGROUND OF THE INVENTION

1. The Field of the Invention

The present invention relates generally to exercise equipment. More specifically, embodiments of the present invention relate to exercise devices, such as stability balls, that enhance the user's exercise by destabilizing the user.

2. The Related Technology

Over the years those engaging in physical fitness exercises have used a variety of different ways to achieve their desired exercise goals. For example, individuals exercise by carrying out routines using their own weight for resistance, such as push-ups and sit-ups. To meet their exercise needs, exercisers have also used hand weights and/or devices that use a system of cables, pulleys, weights, springs, and/or resilient Recently, however, those engaging in physical fitness activities have recognized the value of exercise devices that place the user in an unstable position. One such device is a stability ball, also known as an exercise ball or Swiss ball.

The stability ball is a large flexible ball that is used to create instability during an exercise routine. As the unstable user exercises, he or she exercises his or her core muscles to maintain balance during the exercise routine. For instance an exerciser can lie on the stability ball while exercising with hand weights. The instability of the ball requires the user to flex and exert core body muscles to maintain balance while performing the hand weight exercise. Instead of simply exercising a targeted group of muscles, the exerciser on a stability ball also uses core or stabilizing muscles, particularly those in the abdominal region. Stability balls are known to develop balance and stability by exercising the core body muscles.

One problem with stability balls, however, is that stability balls have a tendency to move or roll relative to an underlying support surface. While it is desirable for the stability ball to create instability in an exerciser, it is undesirable for the stability ball to randomly move or roll relative to the support surface. For example, a stability ball that is instable with respect to the support surface tends to roll out of position unless the user is continuously in contact with it. A user can become occupied with maintaining the position of the ball, thus detracting from the core body training experience.

A particularly advantageous solution for stabilizing a stability ball is to place a small amount of sand or other filler material in the ball. One difficulty with placing a filler material in a stability ball is that traditional valves make it difficult to inject the filler into the ball. Furthermore, valves currently in use with stability balls prevent certain grains of filler from being placed in the ball due to grain size.

BRIEF SUMMARY OF THE INVENTION

Embodiments of the present invention overcome various aspects of the aforementioned problems by providing an exercise device, such as a stability ball, that is at least partially stabilized with respect to a support surface and that can be easily filled with a filler material.

In an exemplary embodiment, the partially stabilized exercise device includes a removable valve main body that allows a filler material to be easily placed in the inflatable bladder through a large aperture in the bladder. Once the filler material is in the inflatable bladder, the valve main body is fitted into the large aperture in the bladder. The aperture in the bladder and a portion of the valve main body are configured to engage to form a seal.

The valve main body also includes a small aperture for inflating the bladder with air. Any valve of a suitable size can be used in the valve main body. For example, a suitable valve includes a channel that is occluded using a stem plug.

Upon inflation, the bladder forms a stability ball or similar shaped device. In one embodiment, the exercise device has a diameter greater than 15 cm and its thickness, surface area, and dimensions are configured to support the weight of a user exercising thereon.

A loose filler is disposed within the exercise device. The filler is a flowable material that can move inside the ball when the ball is moved. For example, the filler can be a material such as sand that flows on the inner surface of the ball in the event that the ball is moved, such as when the ball is rolled along a floor.

The weight of the filler is selected according to the size of the ball and the desired stability. Generally the more voluminous the ball the more filler that can be utilized to stabilize the exercise device with respect to the support surface. In one embodiment, the ratio of the weight of the filler to the diameter of the ball is in a range from about 3.5 grams/cm to about 35 grams/cm. In another embodiment, the ratio is in the range from about 10 grams/cm to about 25 grams/cm. In yet another embodiment, the ratio is about 15 grams/cm to about 20 grams/cm. In another embodiment, the amount of filler is related to the volume of the inflated bladder. For example, in one embodiment the ratio of the weight of the filler to the volume of the ball is in a range from about 2 grams/liter to about 26 grams/liter. In another embodiment, the ratio is from about 6 grams/liter to about 20 grams/liter. In yet another embodiment, the ratio is from about 10 grams/liter to about 16 grams/liter.

The filler is selected to flow on the interior surface of the ball. The amount of filler in the ball is relatively small such that it forms a small pile or layer at the bottom of the ball. This small amount of weight, however, is effective for minimizing unwanted movement of the ball on a flat surface. However, the amount of filler utilized is sufficiently small that it does not appreciably affect the instability that a user experiences when exercising or balancing on the ball.

The improved exercise device of the present invention advantageously provides a bladder that is instable with respect to a user but stabilized with respect to a surface. The stability of the exercise device with respect to the surface allows a user to place the stability ball at a desired location without the ball moving or rolling away. This feature frees the user to attend to other devices and/or matters without needing to prevent movement or rolling of the ball.

In one embodiment, the stability ball of the present invention has a small amount of filler so that the overall operability of the ball during exercises is largely unchanged, while the unwanted movement of the ball is minimized when the ball is not in use. The forces exerted by the user on the ball are much greater than the resistance to rotation created by the filler. Consequently, the user's stability on the ball and exercise benefits provided by the ball are essentially unaffected by the filler. As such users of the stability ball of the present invention can perform all the beneficial exercises associated with other stability balls.

The valve mechanism of the present invention facilitates the placement of the filler material in the stability ball. The large aperture in the bladder allows the filler material to be easily placed in the stability ball, while the small aperture in the valve main body allows the stability ball to be easily inflated with air. By providing a two aperture system, the stability ball can be easily filled by someone other than the manufacturer, such as a retailer, wholesaler, or even the user. Because the stability ball can be easily filled with filler material, the stability ball can be manufactured and then shipped to another location before the filler material is placed in the ball. Shipping the stability ball without the filler material can significantly reduce shipping costs.

The present invention also includes methods for depositing the filler (e.g., sand) in the inflatable bladder. In an exemplary embodiment forced air is used to assist depositing a proper amount of filler in the bladder. The stability ball is inflated or partially inflated as the air and filler (e.g., sand) are forced into the ball. Once the filler is deposited in the bladder, the air can be released to compress the ball for packaging and/or shipping. Depositing the filler using forced air significantly reduces the time it takes to insert the filler through the valve. The methods of depositing the filler material in the inflatable bladder are advantageous because they allow the stability ball to be shipped without the filler material to reduce the weight during shipping, thereby saving costs.

These and other features of the present invention will become more fully apparent from the following description and appended claims.

BRIEF DESCRIPTION OF THE DRAWINGS

To further clarify the above and other advantages and features of the present invention, a more particular description of the invention will be rendered by reference to specific embodiments thereof, which are illustrated in the appended drawings. It is appreciated that these drawings depict only typical embodiments of the invention and are therefore not to be considered limiting of its scope. The invention will be described and explained with additional specificity and detail through the use of the accompanying drawings in which:

FIG. 3C shows a cross-section elevational view of the exercise device of

FIG. 3A, after the exercise device has undergone movement and come to rest;

DETAILED DESCRIPTION OF EXEMPLARY EMBODIMENTS

I. Introduction and Definitions

The present invention relates generally to partially stabilized exercise devices. The exercise devices are partially stabilized using a small amount of filler. The present invention allows the bladder to be easily filled by (i) providing separate apertures for injecting filler and air into the bladder, and/or (ii) by injecting a mixture of filler and air into the bladder using air pressure.

The present invention also includes kits that allow a user to fill the bladder with filler and/or to fill the bladder with air. The kits typically include a small pump such as a hand or foot pump that can be used to force air into the bladder.

In one embodiment, the exercise device is stabilized with respect to a support surface. By being stabilized with respect to the support surface, rolling, rotation along the support surface, or other movement of the exercise device is minimized. Such movements can be referred to as rotation along a surface and should not be considered as limiting as to the type or nature of movement of the bladder. For simplicity, the exercise device will be referred to as a "stability ball," or simply a "ball." The term stability ball is used to generally describe the exercise devices that relate to the present invention and can be used to refer to a variety of types and configurations of balls including an exercise ball, Swiss Ball, physioball, fitness ball, yoga ball, Pilates Ball, etc. Furthermore, those skilled in the art typically refer to the size of a stability ball by its diameter as measured in centimeters. For ease of understanding, the disclosure herein follows this convention of measuring stability balls by their diameter in centimeters.

Various ratios disclosed herein are calculated based on the diameter, volume, or other parameter of a bladder inflated to its normal operating pressures. The size of the bladder inflated to normal operating pressures can be substantially similar to the size of the bladder at the point where the bladder has sufficient air pressure such that it does not significantly deflected under its own weight.

Calculations made herein also assume that the inflated bladder has a spherical shape. This convention is used for the ease of describing the invention and is in no way a limitation on the shape of the invention. Those skilled in the art will recognize that the diameter of a sphere is easily converted to and from volume by the equation $4/3\pi r^3$. Where size of a non-spherical bladder is relevant, the diameter of that bladder should be determined by taking the volume of the non-spherical bladder and calculating its diameter as if it where a sphere.

II. Inflatable Bladder and Filler

Figure 1:
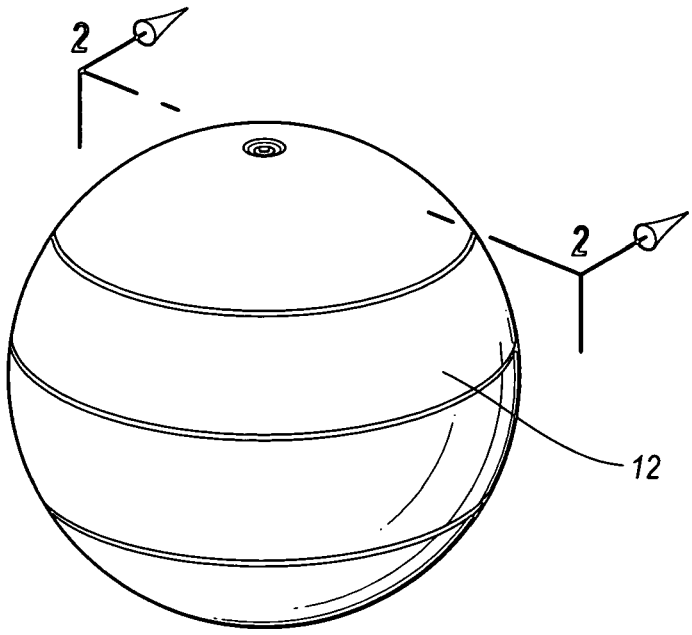
FIG. 1 illustrates a perspective view of an exemplary exercise device of the present invention.
Figure 2:
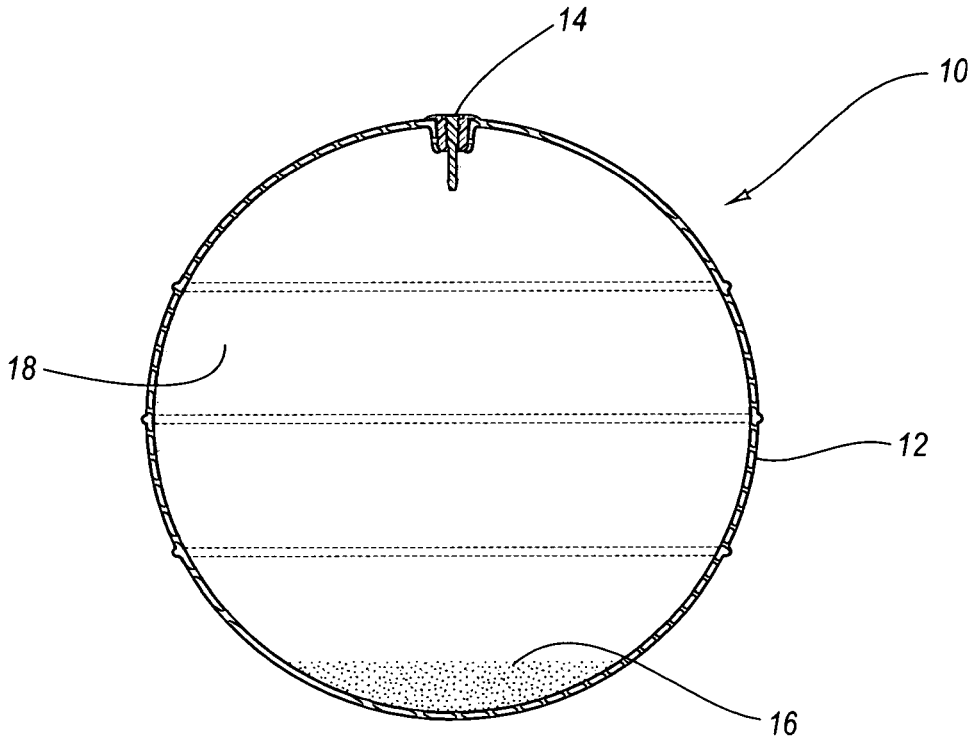
FIG. 2 shows a cross-section elevational view of the exercise device of FIG. 1.

With reference now to FIGS. 1 and 2, in an exemplary embodiment, a stability ball 10 has an inflatable bladder 12 that defines a chamber. In one exemplary implementation, bladder 12 can be inflated and deflated through valve mechanism 14. Stability ball 10 also includes a small amount of filler 16 disposed within bladder 12.

Bladder 12 can be inflated with air, for example, using a pump. The air can be any gaseous substance. The amount of air pressure in the bladder can vary according to personal preferences. The air pressure should be sufficient to support the weight of the user thereon. A user's weight is sufficiently supported by bladder 12 so long as when the user is positioned thereon bladder 12 flexes only so far such that at least a portion of the user's weight is directly supported by bladder 12 rather than by the underlying support surface. Further reference herein to bladder 12 assumes that bladder 12 is inflated.

Bladder 12 is sufficiently large for a user to perform exercises utilizing bladder 12. In one embodiment the diameter of the ball is in the range of about 15 cm to about 115 cm, e.g., about 23 cm to about 105 cm. Typically, bladder 12 is utilized by a user by performing exercises thereon.

Examples of useful sizes of bladders include spherical bladders 12 that have diameters of approximately 23 cm, 35 cm, 45 cm, 55 cm, 65 cm, 75 cm, 85 cm, 95 cm, and 105 cm. These sizes can be determined based on the age, size, and/or experience of the user. For example, typically, for an adult the bladder is about 55 cm to about 75 cm in diameter, whereas youth sizes can typically begin at about 35 cm in diameter.

The stability ball 10 of the present invention can also have a non-spherical shape. Non-spherical shapes include various shapes such as elliptical, egg-shaped, and bi-lobed. In particular, stability ball 10 can be any shape that has some degree of curvature such that a user will be at least partially destabilized when positioned thereon. The curvature also causes instability of the ball with respect to the support surface. In other words, stability ball 10, however shaped, should still have a limited degree of as movement when a user rests or lies thereon.

To keep the weight of stability ball 10 at a minimum, bladder 12 can be made from a thin, lightweight and sturdy material such as, for example, polyvinyl chloride. In one embodiment, bladder 12 is formed from a burst resistant material such as a material comprising primarily polyvinyl chloride in combination with other materials, compounds, or the like. Generally the lighter and stronger the material, the more suitable the material is for forming bladder 12. To be suitable for exercising thereon, bladder 12 resists bursting under pressures exerted by a user thereon. Example burst weights include weights from 200 to 1000 lbs. Ideally, these weights take into account both the weight of the user as well as additional weight apparatus the user holds during an exercise routine. The texture, flex, and cost of the bladder material parameters can be selected to allow for such weights and pressures, In one embodiment, the outside surface of the ball is grip textures. Other materials can be selected or added to those disclosed herein to enhance structural integrity as desired. Those skilled in the art will recognize that bladder 12 can be formed from any one of a number of materials.

In an exemplary embodiment, filler 16 is deposited within bladder 12 by way of valve mechanism 14. Filler 16 can be a particulate, e.g., a fluidly moving particulate, or other material, such as a dense or loose material that can flow on the inner surface 18 of bladder 12. Suitable fillers include sand, weighted beads, gel, water, and the like. Filler 16 forms a small pile or layer on the bottom of inner surface 18. The small amount of filler 16 is sufficient to weight stability ball 10 and provide a small amount of resistance against rolling.

The amount of filler 16 utilized with respect to the overall volume of the bladder can be selected to provided desired results. In one embodiment, the volume of the filler is less than about 75 percent of the overall volume of the bladder. In another embodiment, the volume of the filler is less than about 50 percent of the overall volume of the bladder. In another embodiment, the volume of the filler is less than about 25 percent of the overall volume of the bladder. In another embodiment, the volume of the filler is less than about 10 percent of the overall volume of the bladder. In another embodiment, the volume of the filler is less than about 5 percent of the overall volume of the bladder. In another embodiment, the volume of the filler is less than about 1 percent of the overall volume of the bladder. In one embodiment, the volume of the filler is approximately 0.5 percent of the overall volume of the bladder. In one embodiment, the volume of filler relative to the overall volume of the bladder is dependent on the type of filler utilized. For example, in one embodiment in which the filler comprises sand the volume of the filler is approximately 0.5 percent of the overall volume of the bladder.

Figure 3A:
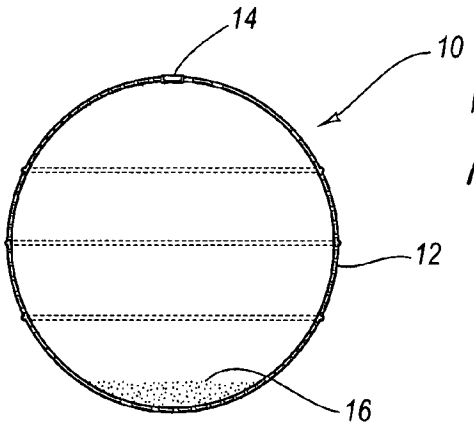
FIG. 3A shows a cross-section elevational view of the exercise device of FIG. 1, prior to movement of the ball.
Figure 3B:
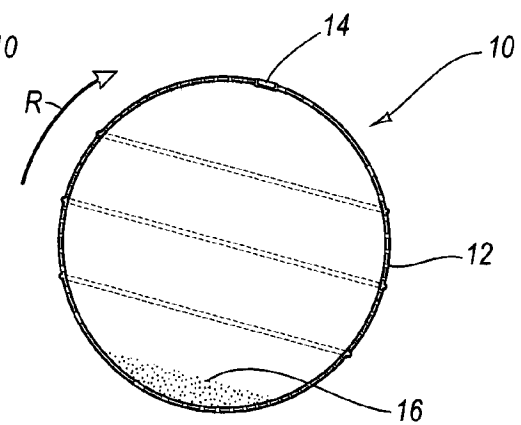
FIG. 3B shows a cross-section elevational view of the exercise device of FIG. 3A, undergoing movement.

FIGS. 3A-3B show the rotation of an exemplary stability ball 10 with filler disposed therein. As shown in FIG. 3A, initially stability ball 10 is at rest and filler 16 is disposed in the bottom thereof. As shown in FIG. 3B, as stability ball 12 begins to roll along a support surface, the friction between inner surface 18 and filler 16 causes filler 16 to move with bladder 12. The weight of filler 16, applied to inner surface 18 through friction, causes stability ball 18 to resist rotation. In order for stability ball 10 to roll, the rotational force applied to ball 10 must be greater than the rotational resistance created by filler 16. By resisting rotation of the ball, unexpected movement of the ball is minimized providing predictability of the location of the ball. This allows users to exercise in the vicinity of the ball while enjoying a safe periphery around the ball. This can be advantageous in certain circumstances in which the stability balls are utilized. For example, in aerobics or cross-training routines in which the ball is intermittently utilized and/or where exercisers are moving in the proximity of the ball.

Figure 3C:
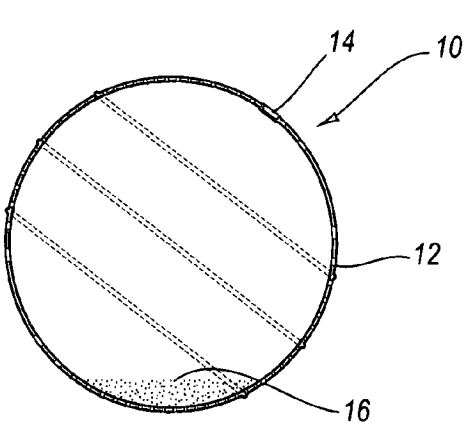

As shown in FIG. 3B, if a sufficiently large rotational force is applied to stability ball 10, ball 10 rotates from the position in FIG. 3A to the position in FIG. 3C, despite the presence of filler 16. Filler 16 is a particulate such as sand or other material that can flow on inner surface 18. Since filler 16 is loose, gravity causes filler 16 to flow toward the bottommost portion of bladder 12.

As shown in FIG. 3C, once stability ball 10 has come to rest, filler 16 is again positioned at the bottom of bladder 12. While FIGS. 3A-3C show filler 16 flowing directly on the inner surface of a single layered bladder, it should be understood, that bladder 12 can have multiple layers.

In one embodiment, the amount of filler 16 is selected to have as little weight as possible and still prevent unwanted ball movement. Existing stability balls are subject to unwanted movement for a variety of reasons including manufacturing imperfections in the ball, imperfections in the floor or support surface, and air currents in the exercise room. The amount of filler in stability ball 10 only needs to produce enough resistance against rotation to overcome the slight forces that cause unwanted movements. Because the forces that cause unwanted rotation are generally relatively small, stability ball 10 generally requires only small amounts of filler. In other words, filler 16 and ball 10 can be configured for a certain degree of "rotational resistance," which is a threshold force required to rotate or move the stability ball a given amount. Thus, for ball 10 to move or rotate, the rotational force applied to ball 10 must be greater than the rotational resistance provided by filler 16.

One will appreciate, therefore, that the stability ball 10 can be configured for greater or lesser stability by varying the size, weight, amount, etc. of filler 16 as discussed above. For example, adding filler 16, or using a heavier filler 16, can increase the rotational resistance. On the other hand, reducing the amount of filler 16, or using a lighter filler 16, can decrease the rotational resistance. However designed, the filler's 16 rotational resistance minimizes unexpected movement of the stability ball 10, providing the stability ball 10 with an added sense of stability in one location, as well as enhancing the predictability of the stability ball 10. Furthermore, the ball's resistance to rotation can vary depending on a particular user's likes or dislikes. therefore, additional weight can be added to the ball as desired.

At least one advantage of minimizing unexpected or unwanted stability ball 10 movement is that users can exercise in the vicinity of the stability ball 10, while enjoying a safe periphery around the stability ball 10. This can be particularly advantageous in circumstances such as in aerobics or cross-training routines, where the stability ball 10 is intermittently utilized and/or where exercisers are moving in the proximity of the stability ball 10. At least a second advantage of this minimization is that users can safely exercise on the stability ball 10 without repeatedly having to adjust the location or orientation of the stability ball 10.

Figure 4A:
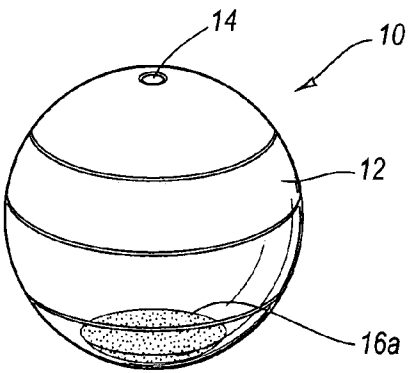
FIG. 4A shows a perspective view of the exercise device of FIG. 1 having a translucent bladder.
Figure 4B:
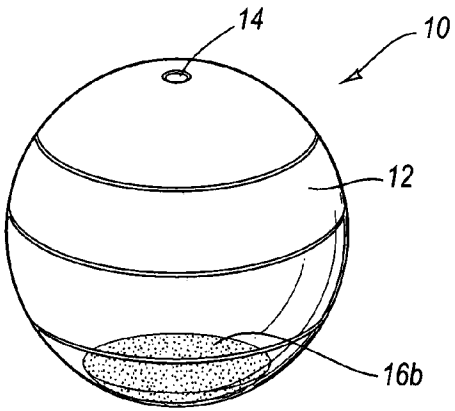
FIG. 4B shows a perspective view of the exercise device of FIG. 4A in a larger size and having more filler therein.
Figure 4C:
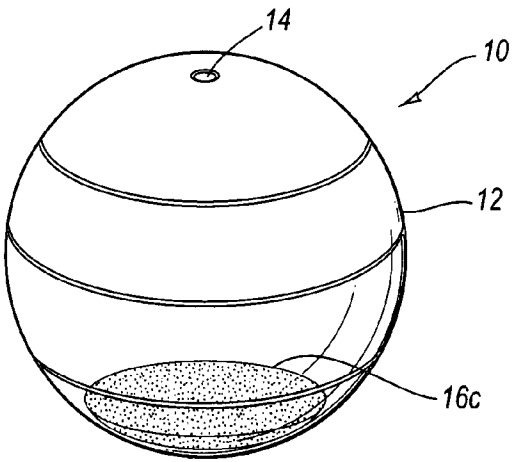
FIG. 4C shows a perspective view of the exercise device of FIG. 4B in a larger size and having more filler therein.

FIGS. 4A-4C show additional exemplary implementations of a stability ball 10, albeit in progressively larger sizes both for the stability ball 10 and bladder 12, as well as for the filler 16. These larger sizes can be based on ultimately desired weights, after the filler 16 has been added.

FIGS. 4A-4C show stability ball 10 in progressively larger sizes. In one embodiment, the weight of the filler utilized is in the range of about 28 grams to about 6.8 kilograms. In one embodiment, the weight of the filler is in the range of about 28 grams of a pound to about 4.55 kilograms. In another embodiment, the weight of the filler is in the range of about 681 grams to about 1.36 kilograms. In yet another embodiment, the weight of the filler is dependent on the type of filler utilized. By way of example, in one embodiment a 23 cm diameter ball has a filler weight of about 113 grams. In another example, a 65-75 cm diameter ball has a filler weight of about 1.13 kilograms.

Filler 16*a*-16*c* disposed in the respective balls of FIGS. 4A-4C increase in weight as the ball size increases. In one embodiment, the amount of weight of the filler utilized is dependent on the size of the bladder. In an exemplary embodiment, the weight of filler 16 disposed in bladder 12 increases with diameter by about 3.5 grams/cm to about 35 grams/cm. In another embodiment, the weight to diameter ratio is in the range of about 10 grams/cm to about 25 grams/cm. In another embodiment, the weight to diameter ratio is from about 15 grams/cm to about 20 grams/cm.

In another embodiment, the amount of filler is related to the volume of the inflated bladder. For example, in one embodiment the ratio of the weight of the filler to the volume of the ball is in a range from about 2 grams/liter to about 26 grams/liter. In another embodiment, the ratio is from about 6 grams/liter to about 20 grams/liter. In yet another embodiment, the ratio is from about 10 grams/liter to about 16 grams/liter.

The amount of filler 16 disposed in bladder 12 can depend on the users' preferences. Thus, a number of stability balls having the same diameter can have different weights. In yet another, the amount of filler is calculated based on another parameter of the bladder. Examples of other parameters can include the weight of the ball, the type of material utilized, the thickness of the material, the type of filler utilized, or the like.

In yet another embodiment of the invention, filler 16 is colored and bladder 12 is translucent such that the color of filler 16 can be detected. The color of filler 16 corresponds to the weight of the filler such that a user can readily identify a particular stability ball among a selection of stability balls. The color of filler 16 can also correspond to the size of bladder 12 such that a user can readily identify a particular sized stability ball. In another embodiment, the color of the filler 16 is selected to correspond to the color of a semi-translucent and colored ball. In yet another embodiment, glitter is utilized alone or in combination with another filler. In yet still another embodiment, indicia are utilized with the balls to indicate the weight of the exercise ball or other parameter of the ball. This can be useful where stability balls of different weights are utilized for resistance during an exercise routine.

III. Performing Exercises on Partially Stabilized Exercise Device

Figure 5:
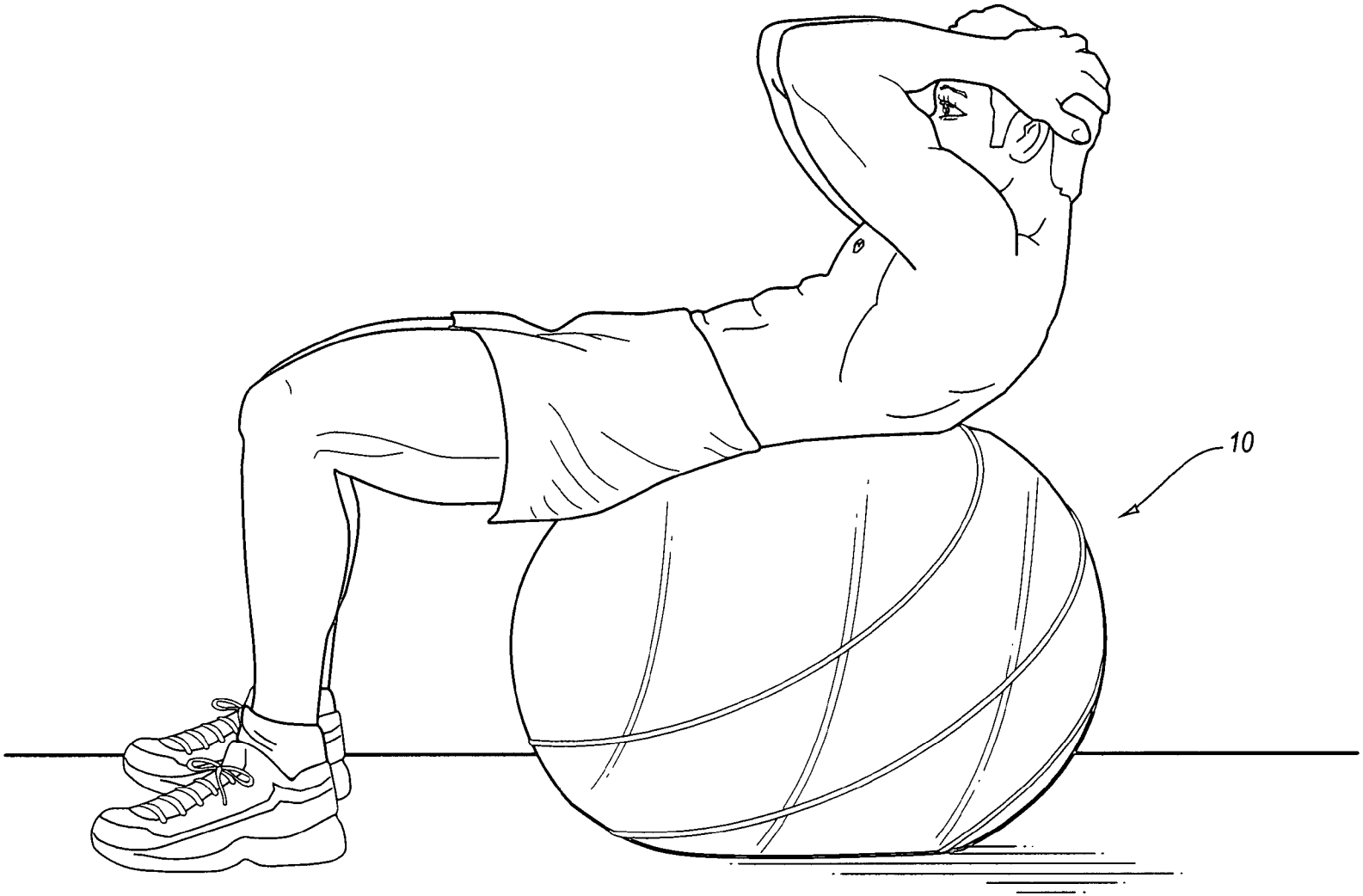
FIG. 5 shows an exerciser performing sit-ups on the exercise device of FIG. 1.

The stability ball of the present invention can be used for numerous activities including all activities performed by a conventional stability ball. FIG. 5 illustrates a user performing sit-ups using stability ball 10 of the present invention. As the user prepares to perform a given exercise the stability ball remains in position on the support surface due in part to the presence of filler 16. If the user has his or her hands occupied with hand weights for example, the user need not worry about controlling stability ball 10 prior to positioning himself or herself thereon.

Once positioned on stability ball 10, the user performs exercises to develop core muscles involved in stabilizing the user's body. The forces of the user's body on stability ball 10 are so much greater than the resistance provided against rotation provided by filler 16 that the user's actions are substantially uninhibited by filler 16 disposed within bladder 12. Thus, as the user performs exercises, stability ball 10 only changes position when caused to be moved by the user.

Figure 6:
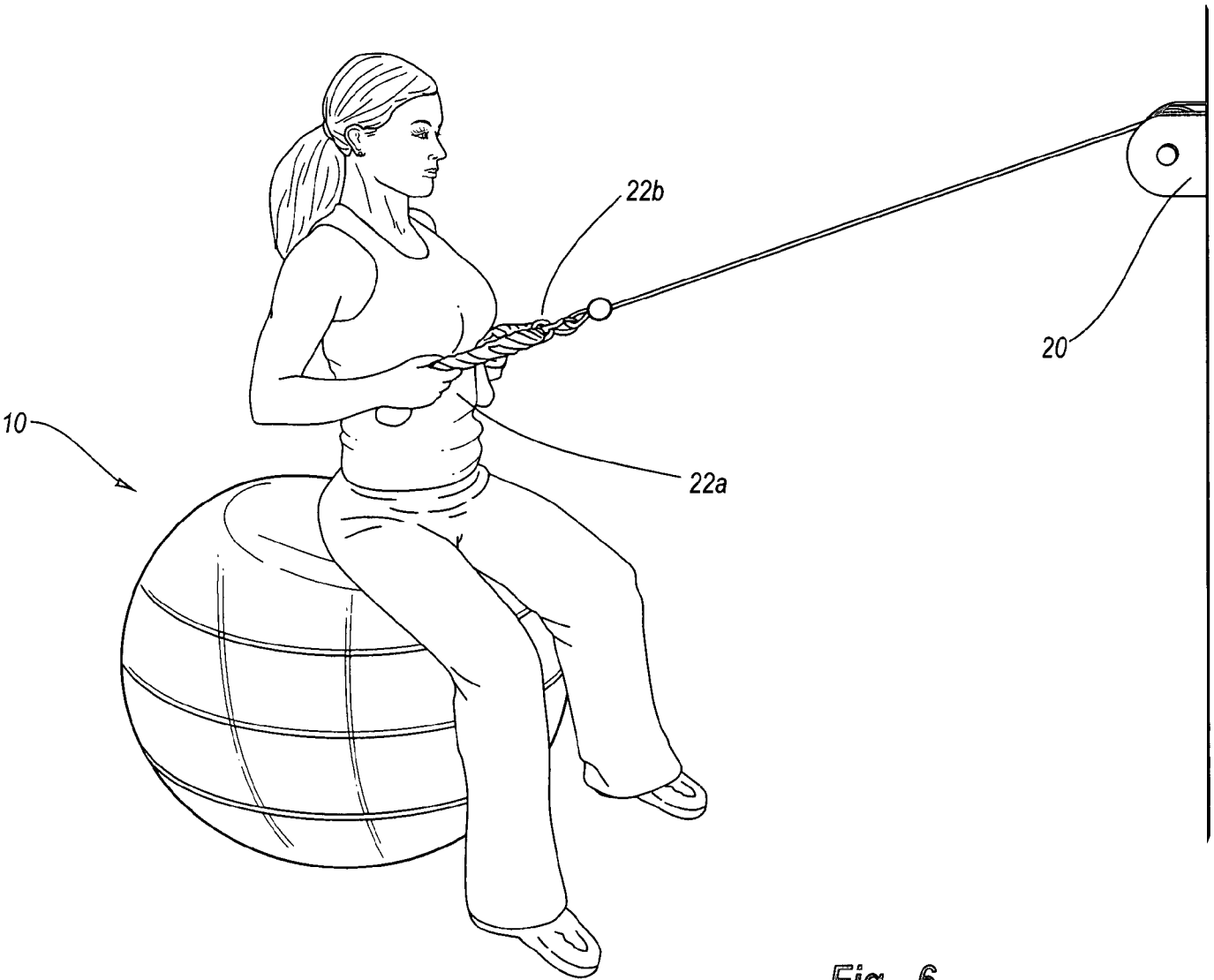
FIG. 6 shows an exerciser using a cable exercise device while sitting on the exercise device of FIG. 1.

FIG. 6 illustrates the advantages of stability ball 10 of the present invention when used in combination with a cable exercise device 20. The user positions stability ball 10 and then grasps handles 22*a* and 22*b*. While the user grasps handles 22*a* and 22*b*, stability ball 10 remains in position due to the presence of filler 16 disposed therein. The user positions himself or herself on stability ball 10 and uses core muscles to stabilize himself or herself as he or she pulls on handles 22*a* and 22*b*. Since filler 16 helps to stabilize the stability ball 10 in a certain position, the user can expend energy on core muscles to stabilize himself or herself as he or she pulls on handles 22*a* and 22*b*, and need not worry about the stability ball 10 moving in an unwanted manner.

A variety of other types and configurations of exercises can be utilized with stability balls of the present invention. For example, a smaller stability ball having a diameter of 23 cm can be placed between the legs of the exerciser to perform certain stability and other types of exercises. The filler minimizes movement of the stability ball when the user places the ball on a support surface during rest or at the completion of the exercise routine.

Figure 7:
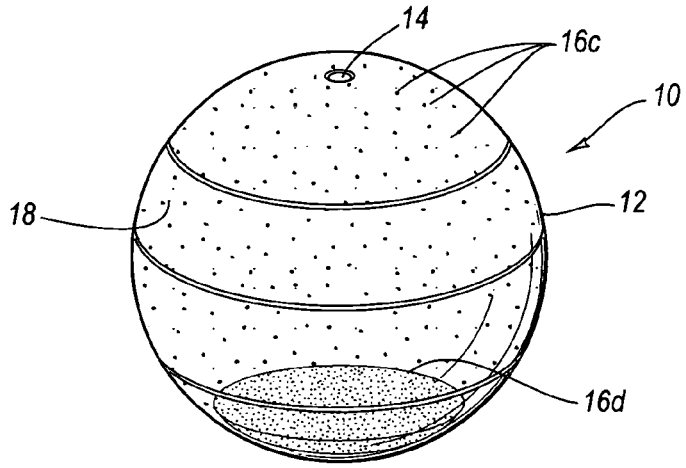
FIG. 7 shows a perspective view of an exemplary exercise device in which some filler particles stick to an inner bladder wall.

In still another embodiment, as shown in FIG. 7, colored filler 16*d* can be used that at least partially adheres, at least momentarily, to the inner surface 18 of the bladder 12, which, in this embodiment is preferably light permeable (e.g., transparent or translucent). The filler can adhere to the inner surface 18 due to forces such as, for example, electrostatic forces. In such a case, at least a portion of the filler 16*d* sticks to the inner walls 18 of bladder 12, thereby adding more visual appeal to the light permeable stability ball 10 when the filler 16*d* is colored, or glittering. One can appreciate, therefore, that a manufacturer and/or user may employ a wide range of fillers 16*d* to indicate a host of properties associated with the stability ball 10 and/or to make the ball more visually appealing.

IV. Alternative Embodiments of Exercise Devices

In yet additional embodiments, the stability ball 10, as described herein, can be further configured so that the ball 10 has a designated upper portion and a designated lower portion. In one embodiment, the lower portion of the bladder is configured such that it is the natural tendency of the lower portion to rest adjacent the support surface, such as a floor, while the upper portion is positioned away from and above the support surface.

Figure 8:
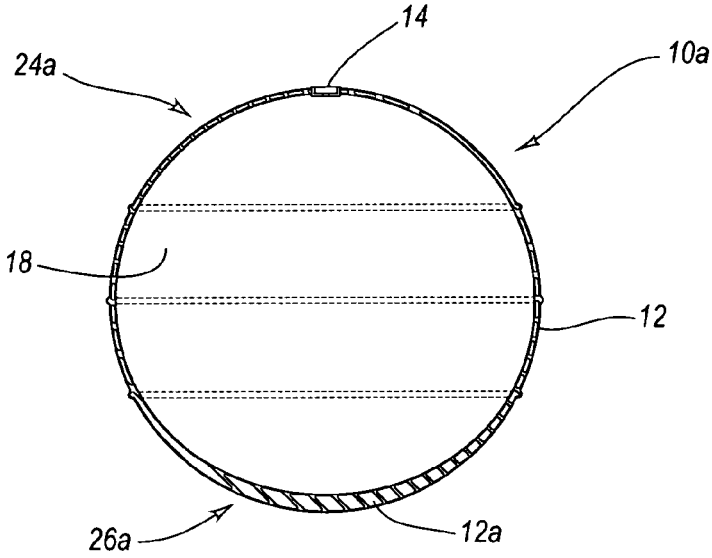
FIG. 8 shows a perspective view of an exemplary exercise device in which a bottom portion is defined by a thicker portion of the exercise device.

For example, in the exemplary embodiment shown in FIG. 8, the stability ball 10*a* has a designated lower portion 26*a* of the bladder 12 that is defined in part by a thicker, and hence heavier, portion 12*a* of the bladder 12 wall than the remaining portions or walls of the bladder 12. The heavier weight of the stability ball 10*a* at one end, i.e., the lower portion 26*a*, ensures that the stability ball 10*a* rests in a specific position. If lower portion 26*a* is rotated off the support surface, absent an external force, gravity causes the lower portion 26*a* to rotate until it rests on the surface. In an exemplary embodiment, the extra weight of thicker portion 12*a* is the minimum amount of weight necessary to resist unwanted rotation such as rotation caused by slightly uneven surfaces or air currents in a room.

In one embodiment, thicker portion 12*a* is formed as part of bladder 12. For example, during the manufacture of bladder 12, thicker portion 12*a* can be a thicker gauge of the same material forming the rest of bladder 12. In another embodiment, thicker portion 12*a* is a separate material weight that has been formed onto or inserted into or fixed to a particular location of lower portion 26*a*. For example a pouch having a material such as sand can be fixed to the inside surface of lower portion 26*a* or inserted in a pocket of material of lower portion 26*a*.

Figure 9:
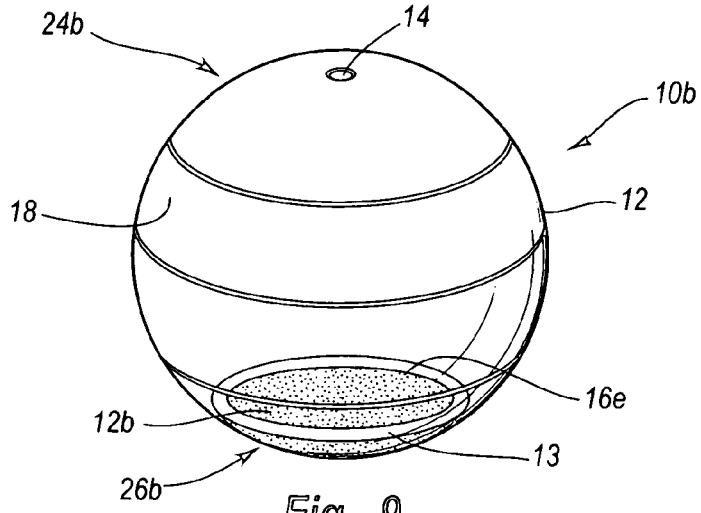
FIG. 9 shows a perspective view of an exemplary exercise device in which a bottom portion is defined by a bowl portion coupled to an inner wall of the exercise device.

Similarly, as shown in FIG. 9, the stability ball 10*b* can be further configured so that a ringed, or lipped, portion 13 defines a bowl portion 12*b* on lower portion 26*b*. In one embodiment, bowl portion 12*b* may comprise a ringed, or lipped, upper area 13 and a thicker bottom area such as thicker area 12*a* shown in FIG. 8. However, in other embodiments, the bowl portion 12*b* comprises only a ringed, or lipped, upper area 13 without a thicker portion such as thicker area 12*a*.

The ringed, or lipped, portion 13 of the bowl portion 12*b* can be formed with the bladder 12 during bladder formation. Alternatively, the ringed, or lipped, portion 13 can be formed from a separate material, inserted, and fixed into a specific point of lower portion 26*b*. In any case, the bowl portion 12*b* adds weight to lower portion 26*b* of the stability ball 10*b*, and/or gathers the filler 16*e* in a relatively defined area. In particular, the ringed portion 13 of the bowl portion 12*b* can cause filler moving within the ball 10*b* to gather within the bowl portion 12*b*. Bowl portion 12*b* is yet another way of increasing the resistance to movement of the stability ball. One can also appreciate that filler 16*e* is not necessary, depending on the thickness, orientation, and stability of the thicker portion and the ringed, or lipped, area of the bowl portion 12*b*.

FIGS. 8 and 9 show stability balls 10*a* and 10*b* in a natural position. The natural position is the position that gravity will cause the ball to assume in the absence of other significant forces, such as an exerciser pushing the ball. In FIGS. 8 and 9, stability balls 10*a* and 10*b* are in the natural position such that upper portions 24*a* and 24*b* respectively, is positioned away from and above a support surface. Thicker portion 12*a* and bowl portion 12*b* create a natural tendency for the lower portions 26*a* and 26*b* respectively, of each ball to rest adjacent the support surface.

Figure 10:
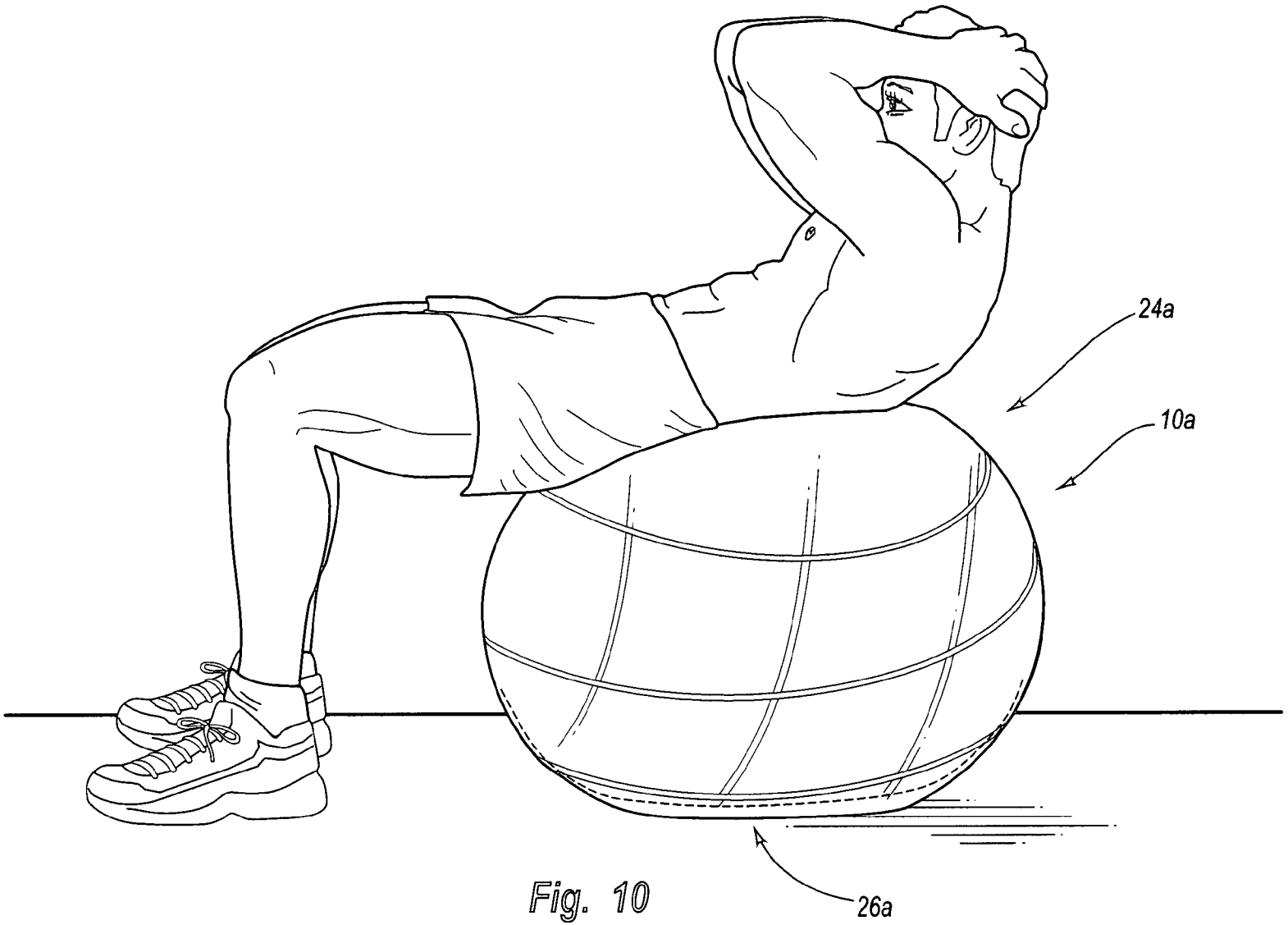
FIG. 10 shows the exerciser of FIG. 5 exercising on the bladder of FIG. 8.
Figure 11:
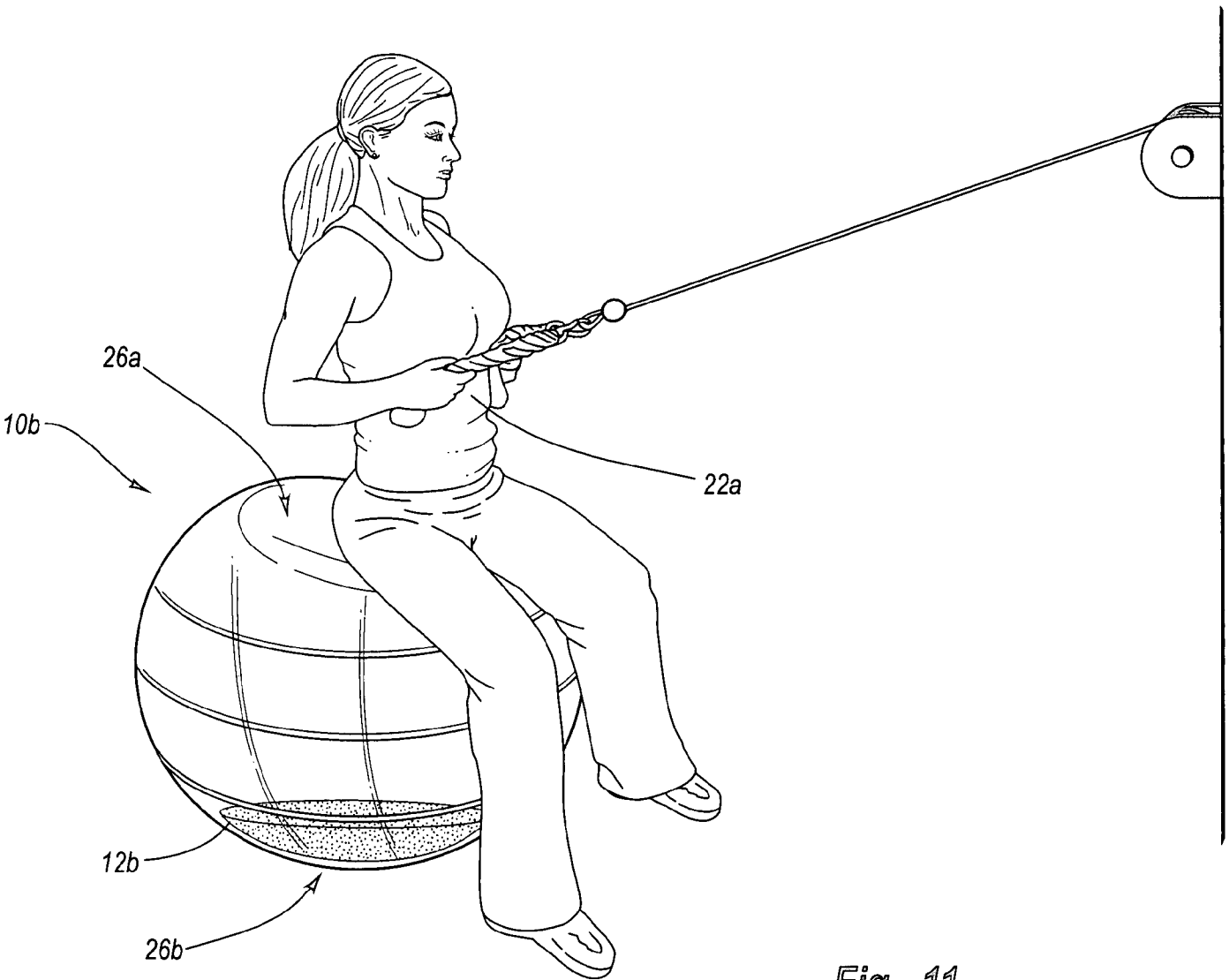
FIG. 11 shows the exerciser of FIG. 6 exercising on the bladder of FIG. 9.

In one embodiment, the stability ball 10*a* shown in FIG. 10 has a lower portion 26 that has a natural tendency to assume a natural position, such as by having a thicker wall 12*a* as shown in FIG. 8. The ball 10*b* shown in FIG. 11 has a lower portion 26*b* that has a natural tendency to assume a natural position by having a bowl portion 12*b*, as shown in FIG. 9. FIGS. 10 and 11 each show a user supported on an upper portion 24*a* and 24*b* respectively, while the lower portion 26*a* and 26*b* respectively is adjacent a support surface. FIG. 11 shows a user on an upper portion 24*b* while a bowl portion 12*b* of bottom portion 26*b* is adjacent the support surface.

As shown in FIGS. 10 and 11, the bladder of a ball having a lower portion with a thicker wall and/or a bowl portion can support a user exercising thereon when stability ball 10 is in the natural position. Thus, FIGS. 8A and 8B show examples of bladders supporting users exercising on the upper portion of the respective bladders while the ball is in the natural position.

V. Valve Mechanisms for Filling the Bladder with a Filler

The exercise devices of the present invention also include a valve mechanism for placing filler into the bladder. The filler material can be more easily deposited in the bladder by either providing a large aperture in the bladder and/or by using a mixture of forced air and filler material.

In an exemplary embodiment, the stability ball includes a first aperture for introducing a filler into the bladder and a second aperture for filling the bladder with air. By using two different sizes of aperture, the apertures can be optimized for placing filler and air into the bladder.

Figure 12:
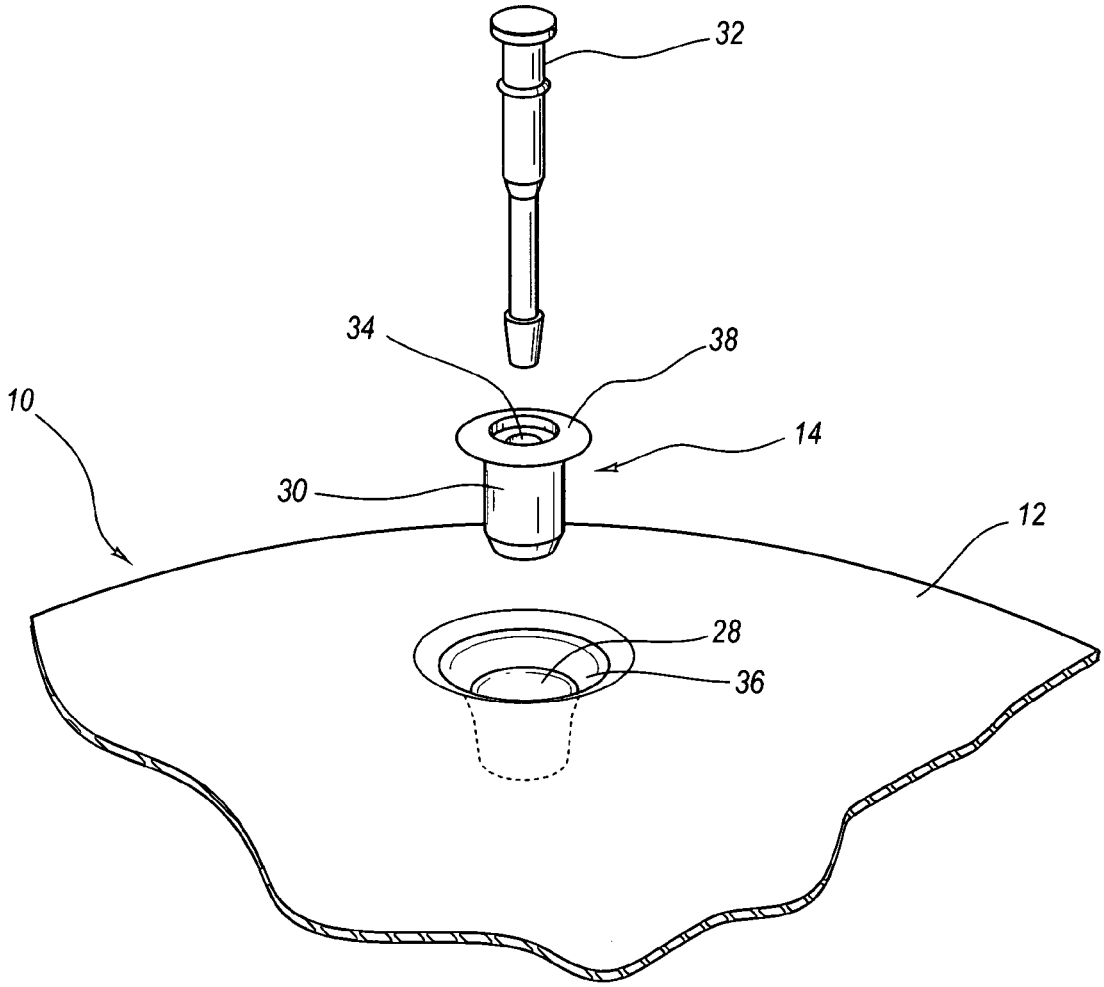
FIG. 12 shows a partial exploded view of the valve and bladder of the exercise device of FIG. 1.
Figure 13A:
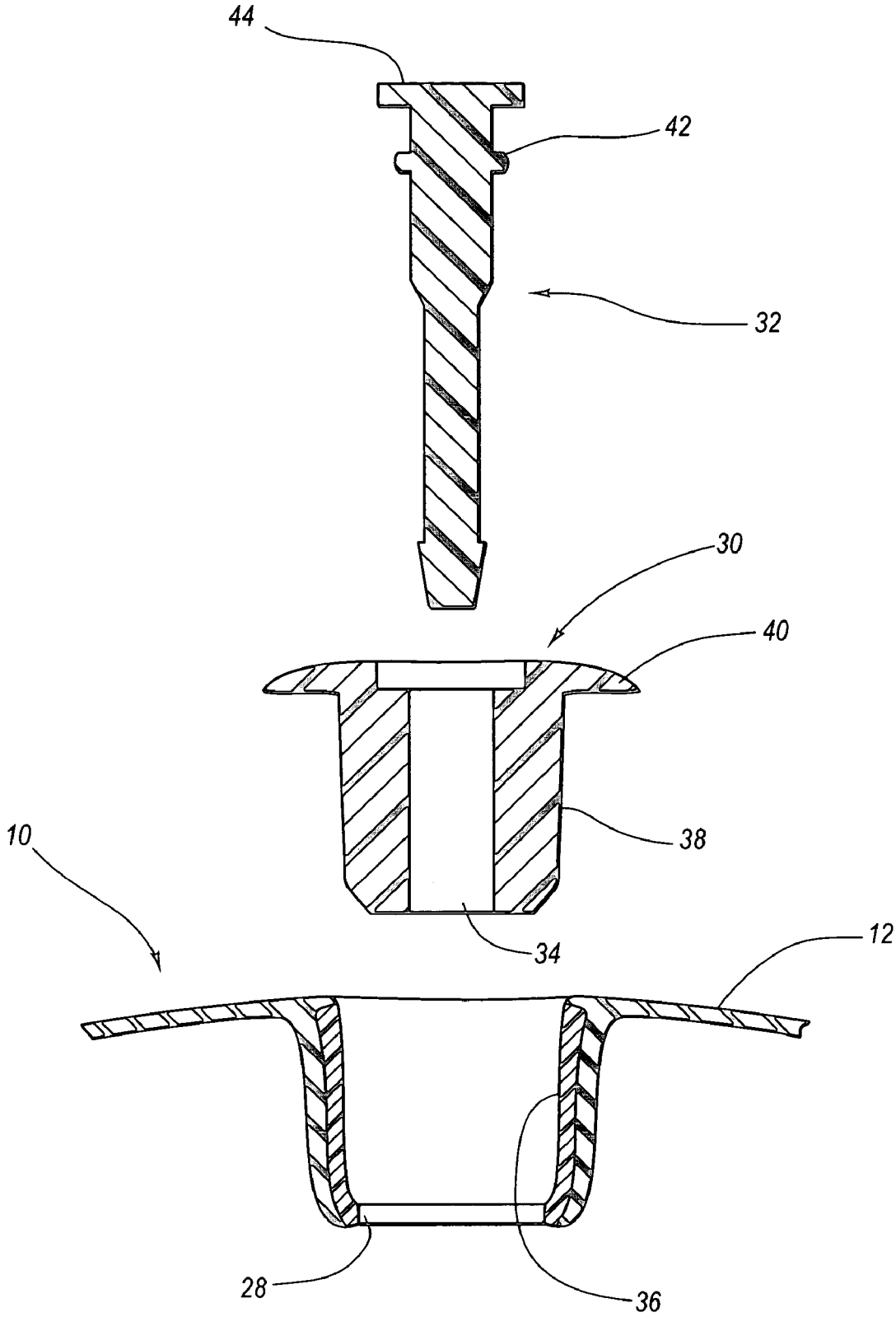
FIG. 13A shows an exploded cross sectional view of the valve and bladder of the exercise device of FIG. 1.

FIGS. 12 and 13A show an exemplary valve 14, which enables the placement of both filler and air into bladder 12 of stability ball 10. The valve 14 comprises a valve main body 30 that can be received in large aperture 28 to plug aperture 28. Valve main body 30 has a small aperture 34 that can receive stem plug 32 to plug aperture 34.

Large aperture 28 allows a filler material to be easily placed in bladder 12. In an exemplary embodiment large aperture 28 has a diameter between about 1 cm and about 3 cm, e.g. between about 1.25 cm and about 1.75 cm.

The stability ball also includes a smaller aperture 34 for inserting air. In an exemplary embodiment, smaller aperture 34 has a diameter between about 0.5 cm to about 1.0 cm.

Smaller aperture 34 can be configured to receive standard air nozzles such that the stability ball can be filled using a variety of air compressors.

Figure 13B:
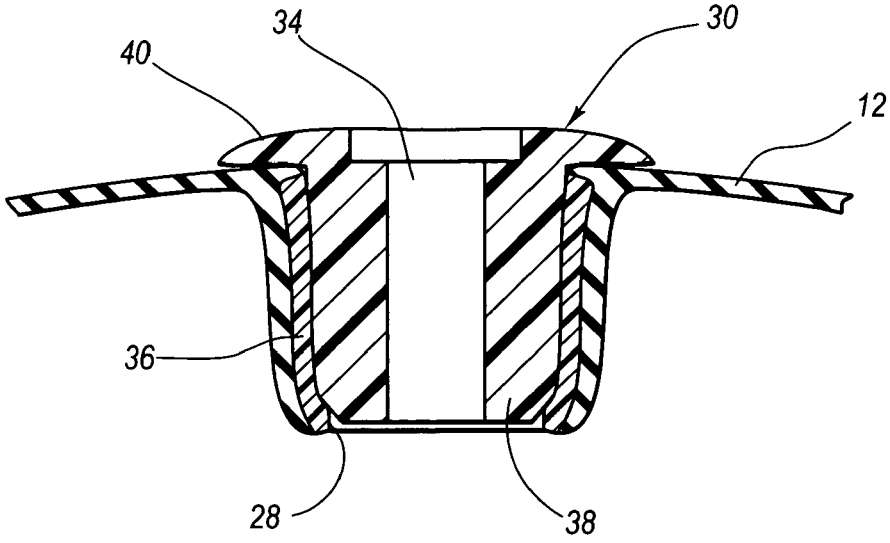
FIG. 13B shows a cross sectional view of the bladder and valve of FIG. 12 with the valve main body seated in the bladder.

As shown in FIGS. 12 and 13B, large aperture 28 is configured to receive valve main body 30. Bladder 12 has a tubular wall 36. Aperture 28 is defined by wall 36, which is sized to receive valve main body 30 in a snug fit. Valve main body 30 includes a insert portion 38 that is substantially the same size or slightly larger than the inside diameter of wall 36. Insert portion 40 can be made from a resilient material such that valve main body 30 can be pressure fitted into aperture 28. The force of the resilient material of valve main body 30 provides friction that inhibits the valve main body from being accidentally removed. The pressure between valve main body 30 and aperture 28 forms a seal that prevents air and the filler from escaping between valve main body 30 and aperture 28 when valve main body 30 is seated in aperture 28. Valve main body 30 can also include a rim 40 that prevents valve main body 30 from passing completely through aperture 28. Wall 36 can be more rigid than the remainder of bladder 12 in order to make placement of the valve more convenient.

In a preferred embodiment, wall 36 comprises a smooth plastic material that can form a good seal with valve main body 30. As shown in FIG. 13B, wall 36 can be a separate piece from the remainder of bladder 12, in which case wall 36 is made from a material that can adhere to the remainder of bladder 12. In an alternative embodiment, wall 36 can be made from the same material as other portions of bladder 12 such that wall 36 is continuous with the remainder of bladder 12.

Figure 13C:
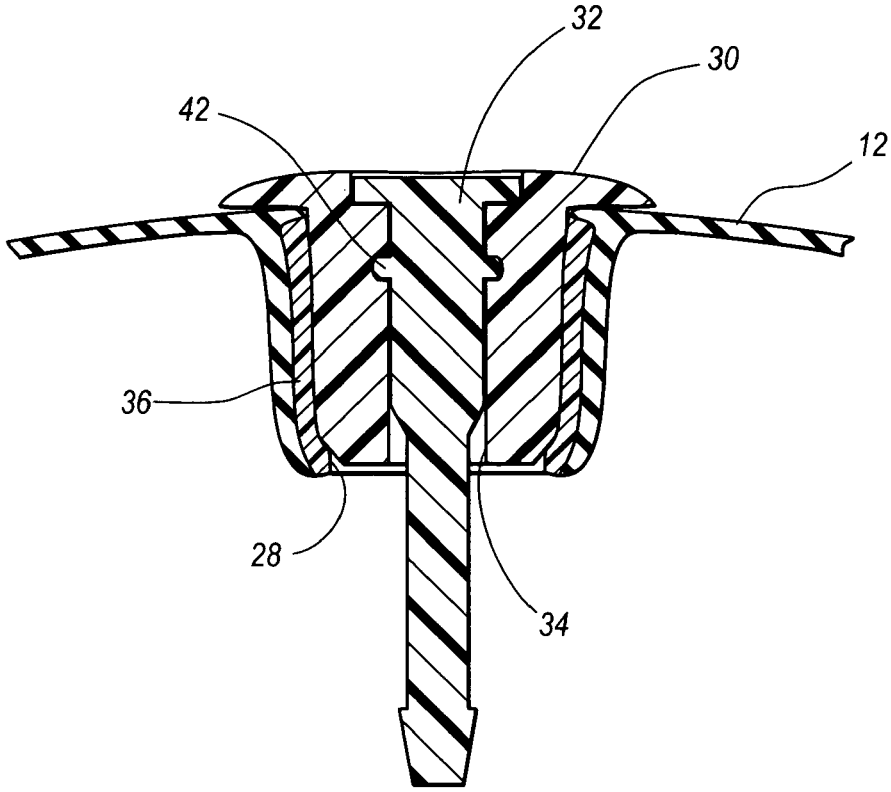
FIG. 13C shows a cross sectional view of the bladder and valve main body of FIG. 12 with the stem plug seated in the valve main body.

FIG. 13C shows the valve with stem plug 32 inserted into aperture 34 to close aperture 34. Stem plug 32 is configured to be slidably received in aperture 34. Stem plug 32 includes a protruding ring 42 that extends circumferentially about stem plug 32. Ring 42 is configured to be substantially the same size or slightly wider than the diameter of aperture 34. As stem plug 32 is inserted into aperture 34, ring 32 engages the inside surface of valve main body 30 to form a seal between stem plug 32 and valve main body 30. When rim 44 is seated against valve main body 30, ring 42 of stem plug 34 is disposed within aperture 34 and forms a seal to prevent air and filler from escaping from the bladder. Stem plug 32 includes rim 44, which prevents stem plug 32 from passing completely through aperture 34.

FIGS. 1-4 and 12-14 thus illustrate examples of a bladder assembly comprising a bladder 12 having a first aperture 28 and a valve 30. The bladder assembly thus has first and second apertures 28, 34. First aperture 28 and second aperture 34 are capable of being selectively opened and closed to allow a filler material and air to be inserted into the bladder assembly.

The present invention also includes other valve mechanisms that provide a first aperture size for depositing a filler material in a stability ball and a second size of aperture for inserting air. For example, in an alternative embodiment, the two sizes of aperture are provided by two separate apertures in the bladder of the stability ball. In addition, other closure and sealing mechanisms can be used with the valve mechanism of the present invention. For example, standard valves that can be opened with a needle can also be used with the present invention.

Bladders having the foregoing valve mechanisms can also be included in kits that allow a user or distributor to inject the sand following manufacturing. In this embodiment, the bladder can be shipped empty and the sand is injected by the user or distributor. A hand or foot pump can be included in the kit to allow the user to inflate the bladder.

VI. Methods For Placing the Filler in the Bladder

A variety of methods using various apparatuses can be utilized to introduce the filler into bladder 12. For example, in one embodiment, a funnel is utilized to pour the filler through aperture 28.

In a preferred embodiment, a pressurized air stream is used to inject the filler material into the bladder. Filler materials that are injected using a pressurized air stream can be introduced into the bladder at a faster rate and/or through a smaller aperture than filler that is poured. By injecting the filler material using a pressurized air stream, the filler can be injected through the same aperture as the air, thus eliminating the need for separate apertures for introducing the filler and the air; although a separate aperture for injecting the filler can be used if desired. Once the desired amount of filler is injected into the bladder, the bladder can be deflated for packaging and/or shipping.

The pressurized air stream can be generated using any air compressor system. Air compressor systems are known to those skilled in the art and typically include pumps, air tanks, hoses, and air nozzles to create an air stream. The air nozzle allows an air stream to be directed in a desired direction.

Figure 14:
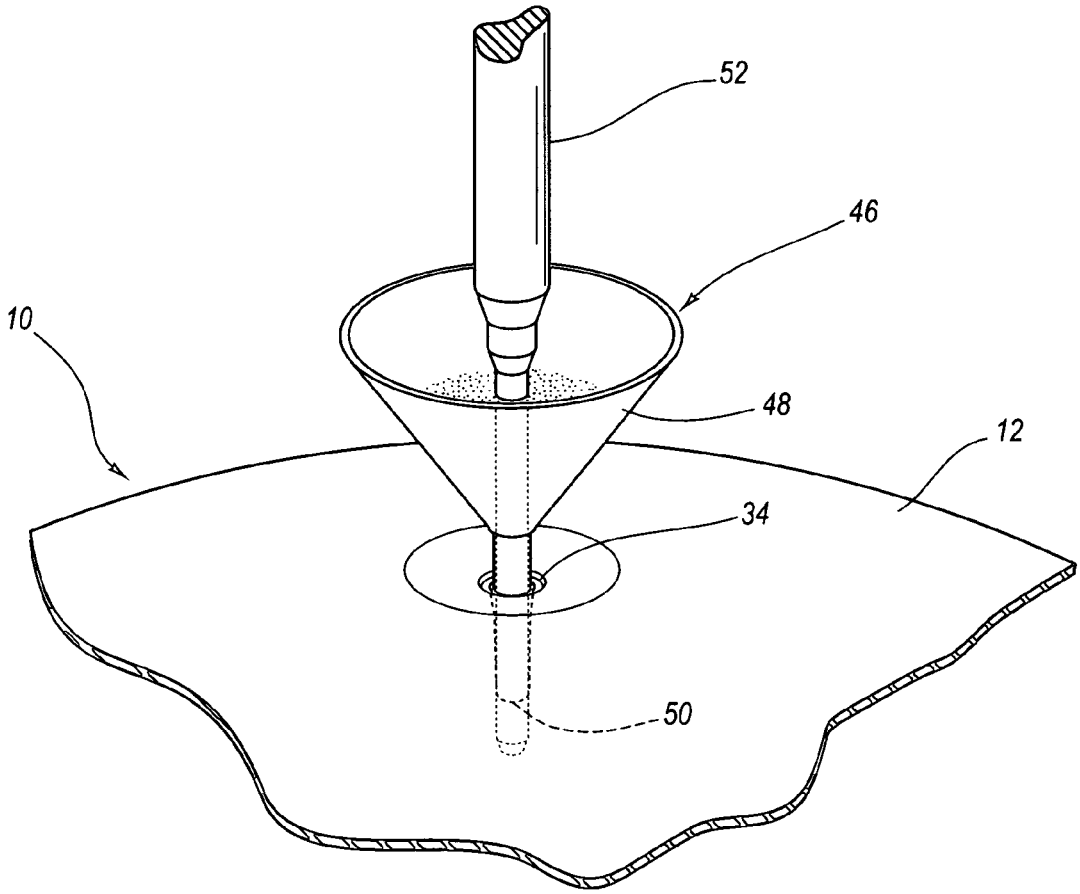
FIG. 14 shows the bladder of FIG. 1 being filled with a mixture of air and filler that is being injected through an aperture in the valve main body using air pressure.

FIG. 14 shows an exemplary setup for injecting a mixture of air and filler into bladder 12. Funnel 46 includes a tapered conical section 48 and an outlet 50. Outlet 50 is position aperture 34. Funnel 46 is partially filled with filler and an air nozzle 52 is partially submerged in the filler such that the air stream ejected there from is below the level of the filler. The air stream is also directed toward outlet 50 of the funnel 46. As the air stream passes through the filler, a mixture of filler and air is formed. The force of the air carries the filler into bladder 12.

Figure 15:
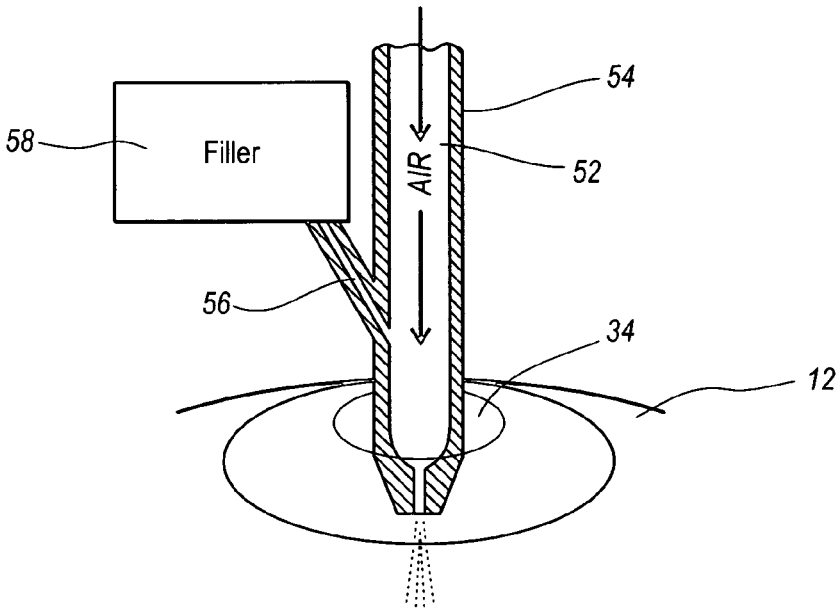
FIG. 15 shows a schematic drawing of a forced air system that creates a vacuum to cause the filler to mix with the air stream.

In an alternative embodiment, the filler can be mixed with the air using a vacuum created by a pressurized air stream. FIG. 15 shows an air stream 52 that is forced down passageway 54. Air stream 54 passing by hollow tube 56 creates a vacuum in hollow tube 56. Hollow tube 56 is also in fluid communication with reservoir of filler 58. Filler from reservoir of filler 58 is sucked into air stream 52 through the vacuum in hollow tube 56. The mixed air stream is injected into the bladder 12 through aperture 34. Alternatively, the mixture of sand and air can be injected through aperture 28 (FIG. 12).

By injecting the filler into the bladder, substantial time can be saved in filling the bladder. Furthermore, the bladder can be easily filled with filler at a location different than where the bladder is manufactured. This allows the bladder to be manufactured and shipped without the filler thereby reduce shipping costs.

The present invention can be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A partially stabilized exercise device for performing core body exercises, comprising:

a flexible, inflatable bladder configured and arranged to support a user exercising thereon when the bladder is inflated, the bladder having a first aperture at least partially defined by an inwardly extending wall, the inwardly extending wall having a frustroconical shape that enables a filler material to be inserted into the bladder;

a loose filler disposed within the bladder to stabilize the bladder with respect to a support surface, the filler being configured to move in the bladder when the bladder is moved; and a valve adapted to seal against substantially all of the inwardly extending frustroconically shaped wall when the valve is inserted into the first aperture so as to form a seal along substantially all of a length of the inwardly extending frustroconically shaped wall, the valve having a second aperture that enables air to be introduced into the bladder to inflate the bladder.

2. The exercise device of claim 1, wherein the seal between the valve and the inwardly extending frustroconically shaped wall adjacent the first aperture may be selectively opened and closed so as to selectively open and close the first aperture.

3. The exercise device of claim 1, wherein at least a portion of the valve is pressure fitted into the first aperture to hold the valve therein when the valve is inserted into the first aperture.

4. The exercise device of claim 3, wherein the valve comprises a flexible rubber material.

5. The exercise device of claim 1, wherein the valve further comprises a valve main body having the second aperture therein and a plug that is selectively inserted into the second aperture to form a seal thereby preventing air from escaping through the second aperture.

6. The exercise device of claim 1, wherein the filler comprises a particulate.

7. The exercise device of claim 1, wherein a weight of the filler and a volume of the inflated bladder have a ratio within a range from about 2 grams/liter to about 26 grams/liter.

8. The exercise device of claim 1, wherein a weight of the filler and a volume of the inflated bladder have a ratio within a range from about 6 grams/liter to about 20 grams/liter.

9. The exercise device of claim 1, wherein a weight of the filler and a volume of the inflated bladder have a ratio within a range from about 10 grams/liter to about 16 grams/liter.

10. The exercise device of claim 1, wherein the outer surface of the ball is grip texturized.

11. The exercise device of claim 1, wherein the first aperture has a diameter greater than about 1 cm.

12. The exercise device of claim 1, wherein the second aperture has a diameter less than about 1 cm.

13. A method for filling a partially stabilized exercise device with pressurized air and a filler material, comprising:

providing a flexible inflatable bladder that is at least partially deflated, the bladder being configured and arranged to support a user exercising thereon when the bladder is inflated, wherein the bladder comprises at least one aperture through which air and a filler can simultaneously be introduced into the bladder; and forcing both pressurized air and an amount of filler simultaneously into the bladder through the aperture so as to inflate the bladder, the filler introduced within the bladder acting to stabilize the bladder with respect to a support surface during exercise by a user on the inflated bladder.

14. The method of claim 13, wherein forcing pressurized air and an amount of filler into the bladder comprises:

inserting a funnel into the at least one aperture of the bladder; and injecting the air from an air nozzle through the funnel and into the bladder, whereby the air mixes with the filler and forces the filler into the bladder.

15. The method of claim 13, wherein forcing pressurized air and an amount of filler into the bladder comprises placing an amount of filler in a funnel and submerging an air nozzle below the level of the filler with an air stream from the nozzle directed toward the outlet of the funnel.

16. The method of claim 13, wherein forcing pressurized air and an amount of filler into the bladder comprises forcing air past a hollow tube to create a vacuum, wherein the hollow tube is in fluid communication with a reservoir of filler such that filler is sucked into the forced air to form the mixture that is injected into the bladder.

17. The method of claim 13, wherein forcing pressurized air and an amount of filler into the bladder comprises injecting an amount of filler such that a weight of the filler and a volume of the inflated bladder have a ratio within a range from about 2 grams/liter to about 26 grams/liter.

18. The method of claim 13, wherein forcing pressurized air and an amount of filler into the bladder comprises injecting an amount of filler such that a weight of the filler and a volume of the inflated bladder have a ratio within a range from about 6 grams/liter to about 20 grams/liter.

19. The method of claim 13, wherein forcing pressurized air and an amount of filler comprises injecting an amount of filler such that a weight of the filler and a volume of the inflated bladder have a ratio within a range from about 10 grams/liter to about 16 grams/liter.

20. The method of claim 13, further comprising deflating and packaging the bladder subsequent to forcing pressurized air and the filler into the bladder.

21. A kit for assembling a partially stabilized exercise device for performing core body exercises, comprising:

a flexible inflatable bladder having a degree of curvature, the bladder being configured and arranged to support a user exercising thereon when said bladder is inflated;

a loose filler suitable for placement within the bladder to stabilize the bladder with respect to a support surface, the loose filler being configured to flow toward the bottommost portion of the bladder when the loose filler is positioned in the bladder and the bladder is stationary, the bladder having a first aperture, the first aperture having a diameter large enough to allow the filler material to be introduced therethrough, the first aperture being at least partially defined by an inwardly extending frustroconically shaped wall; and a valve having a second aperture that can be selectively opened to introduce air into the bladder to inflate the bladder, the valve having an outer surface that seals against substantially all of the inwardly extending frustroconically shaped wall when the valve is placed in the first aperture, wherein the valve can be selectively opened to inject air into the bladder to inflate the bladder.

22. A kit as in claim 21, further comprising an air pump.

23. A kit as in claim 22, wherein the pump is a hand pump or foot pump.

24. A kit as in claim 21, wherein the seal between the outer surface of the valve and the inwardly extending frustroconically shaped wall adjacent the first aperture may be selectively opened and closed so as to selectively open and close the first aperture.

25. A kit as in claim 21, wherein a weight of the filler and a volume of the inflated bladder have a ratio within a range from about 2 grams/liter to about 26 grams/liter.

26. A kit as in claim 21, wherein a weight of the filler and a volume of the inflated bladder have a ratio within a range from about 6 grams/liter to about 20 grams/liter.

27. A kit as in claim 21, wherein a weight of the filler and a volume of the inflated bladder have a ratio within a range from about 10 grams/liter to about 16 grams/liter.

28. A partially stabilized exercise device for performing core body exercises, comprising:

a flexible, inflatable bladder assembly configured and arranged to support a user exercising thereon when the bladder assembly is inflated, the bladder assembly having first and second apertures, the apertures enabling a filler material and air to be introduced into the bladder assembly, wherein the bladder assembly comprises (i) a bladder having the first aperture therein, the first aperture defined by an inwardly extending frustroconically shaped wall, and (ii) a valve, the valve comprising a valve main body having the second aperture therein and a plug configured to plug the second aperture in the valve main body, wherein the valve is sized and configured to seal against substantially all of the inwardly extending frustroconically shaped wall when the valve is placed in the first aperture so as to form a seal along substantially all of a length of the inwardly extending frustroconically shaped wall; and a loose filler disposed within the bladder to stabilize the bladder with respect to a support surface, the filler being configured to move in the bladder when the bladder is moved.

29. A device as recited in claim 28, wherein the first aperture is larger than the second aperture.

30. A partially stabilized exercise device for performing core body exercises, comprising:

a flexible, inflatable bladder configured and arranged to support a user exercising thereon when the bladder is inflated, the bladder having a first aperture at least partially defined by an inwardly extending wall, wherein a filler material can be inserted into the bladder through the first aperture, wherein at least a portion of the inwardly extending wall comprises a separate piece from the bladder, wherein the inwardly extending wall comprises a material that is more rigid than a valve insertable into the first aperture;

a loose filler disposed within the bladder to stabilize the bladder with respect to a support surface, the filler being configured to move in the bladder when the bladder is moved; and a valve having a second aperture that enables air to be introduced into the bladder to inflate the bladder.

31. The device as recited in claim 30, wherein the entire inwardly extending wall comprises a separate piece from the bladder.

32. The device as recited in claim 30, wherein the valve comprises a valve main body adapted to seal against substantially all of the inwardly extending wall when the valve is received into the first aperture so as to form a seal along substantially all of a length of the inwardly extending wall.

33. A partially stabilized exercise device for performing core body exercises, comprising:

a flexible, inflatable bladder configured and arranged to support a user exercising thereon when the bladder is inflated, the bladder having a first aperture that enables a filler material to be inserted into the bladder;

a loose filler disposed within the bladder to stabilize the bladder with respect to a support surface, the loose filler being configured to move in the bladder when the bladder is moved; and a valve having a second aperture that enables air to be introduced into the bladder to inflate the bladder, wherein the first aperture comprises an inwardly extending wall extending into the flexible bladder between a first opening and a second opening, the inwardly extending wall having a frustroconical shape and wherein at least a portion of the valve can be pressure fitted into the first aperture so as to seal against substantially all of the inwardly extending frustroconically shaped wall when the valve is placed in the first aperture so as to hold the valve therein.

34. A partially stabilized exercise device for performing core body exercises, comprising:

a flexible, inflatable bladder configured and arranged to support a user exercising thereon when the bladder is inflated, the bladder having a first aperture that enables a filler material to be inserted into the bladder, wherein the first aperture comprises an inwardly oriented wall extending between a first opening and a second opening, the inwardly extending wall having a frustroconical shape;

a loose filler disposed within the bladder to stabilize the bladder with respect to a support surface, the loose filler being configured to move in the bladder when the bladder is moved; and a valve comprising a valve main body having a second aperture therein that enables air to be introduced into the bladder to inflate the bladder, wherein the valve main body is sized and configured to seal against substantially all of the inwardly extending frustroconically shaped wall when the valve is placed in the first aperture so as to form a seal between the valve main body along substantially all of a length of the inwardly extending frustroconically shaped wall, further comprising a plug that is selectively inserted into the second aperture to form a seal thereby preventing air from escaping through the second aperture.

35. The device as recited in claim 30, wherein the inwardly extending wall comprises a piece of rigid smooth plastic.

* * * * *

UNITED STATES PATENT AND TRADEMARK OFFICE

CERTIFICATE OF CORRECTION

PATENT NO. : 7,713,180 B2
APPLICATION NO. : 11/182174
DATED : May 11, 2010
INVENTOR(S) : Wickens et al.

It is certified that error appears in the above-identified patent and that said Letters Patent is hereby corrected as shown below:

Drawings

Sheet 5, replace Figure 7 with the figure depicted below, wherein filler "16c" has been relabeled --16d--

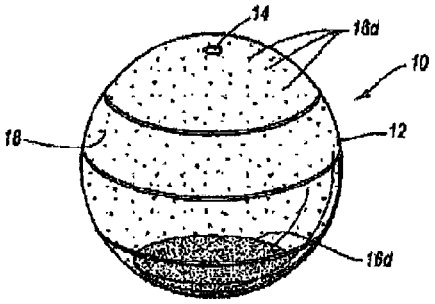

Fig. 7

Sheet 7, replace Figure 11 with the figure depicted below, wherein the item "26a" has been correctly relabeled --24b--

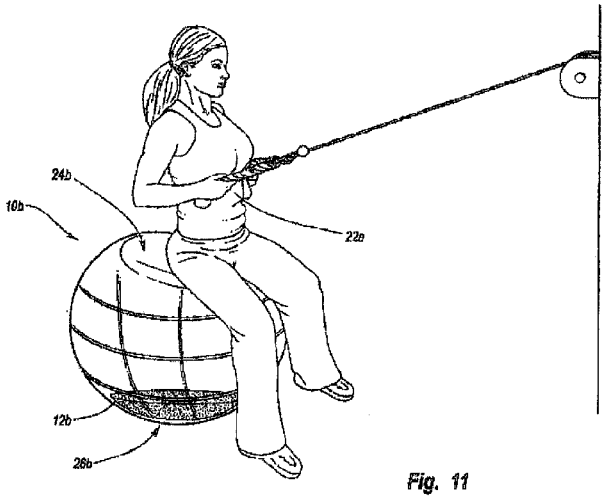

Fig. 11

Signed and Sealed this

Seventh Day of December, 2010

David J. Kappos

David J. Kappos
*Director of the United States Patent and Trademark Office*

Column 1
Line 12, change "STAIBILIZED" to --STABILIZED--
Line 29, change "resilient" to --resilient bars.--

Column 3
Lines 54-55, remove carriage return

Column 5
Line 4, change "deflected" to --deflect--
Line 53, remove [as]
Line 67, change "apparatus" to --apparatuses--

Column 6
Line 3, change "pressures, In" to --pressures. In--
Line 18, change "provided" to --provide--
Line 35, change "sand the volume" to --sand, the volume--
Line 42, change "stability ball 12" to --stability ball 10--
Line 45, change "stability ball 18" to --stability ball 10--

Column 7
Line 32, change "dislikes, therefore," to --dislikes. Therefore--
Line 54, remove [of a pound]
Line 62, change "Filler 16*a*-16*c*" to --Fillers 16*a*-16*c*--

Column 10
Line 19, change "is" to --are--
Line 25, change "26" to --26*a*--
Line 38, change "FIGS. 8A and 8B" to --FIGS. 10 and 11--

Column 11
Line 4, change "13B" to --13A--
Line 8, change "a insert portion" to --an insert portion--
Line 10, change "Insert portion 40" to --Insert portion 38--
Line 38, change "ring 32" to --ring 42--
Line 41, change "stem plug 34" to --stem plug 32--

Column 12
Line 25, change "position" to --positioned in--
Line 28, change "there from" to --therefrom--
Line 36, change "Air stream 54" to --Air stream 52--
Line 48, change "reduce" to --reducing--